US010981773B2

(12) United States Patent
Biegler et al.

(10) Patent No.: US 10,981,773 B2
(45) Date of Patent: Apr. 20, 2021

(54) COMMUNION CUP FILLER APPARATUS AND METHOD

(71) Applicant: Randy L. Monk, Ankeny, IA (US)

(72) Inventors: Steven Patrick Biegler, Marion, IA (US); Blaise Ritter Brown, Ames, IA (US); Ronald Robert Harms, Janesville, IA (US); Boyoung Jin, Seongnam (KR); Nicholaus Gerard Steffensmeier, Lincoln, NE (US); Brian Joseph Van Haaften, Oskaloosa, IA (US)

(73) Assignee: Randy L. Monk, Ankeny, IA (US)

( * ) Notice: Subject to any disclaimer, the term of this patent is extended or adjusted under 35 U.S.C. 154(b) by 0 days.

(21) Appl. No.: 16/506,948

(22) Filed: Jul. 9, 2019

(65) Prior Publication Data

US 2020/0017350 A1 Jan. 16, 2020

Related U.S. Application Data

(60) Provisional application No. 62/698,336, filed on Jul. 16, 2018.

(51) Int. Cl.

| | |
|---|---|
| ***B67D 3/00*** | (2006.01) |
| ***A47G 33/00*** | (2006.01) |
| ***B65B 3/06*** | (2006.01) |

(52) U.S. Cl.
CPC ..... *B67D 3/009* (2013.01); *A47G 33/002* (2013.01); *B65B 3/06* (2013.01)

(58) Field of Classification Search
CPC ..... A47G 33/002; B67D 3/009; B67D 2210/00068; B67D 3/0093; B65B 3/06; B67C 11/02; B67C 11/04; B67C 11/06; B67C 2011/40
See application file for complete search history.

(56) References Cited

U.S. PATENT DOCUMENTS

| | | | | |
|---|---|---|---|---|
| 1,612,383 | A * | 12/1926 | Lepeshkin | B67C 11/02 141/300 |
| 1,709,771 | A | 4/1929 | Brady | |
| 2,872,953 | A * | 2/1959 | Duncan | B67D 3/00 141/237 |
| 3,196,909 | A * | 7/1965 | Monk | B65B 3/04 141/237 |
| 3,664,387 | A * | 5/1972 | Cates, Jr. | B65B 3/30 141/238 |
| 4,453,576 | A | 6/1984 | Burns | |
| 4,733,680 | A * | 3/1988 | Mosier | B65B 3/06 141/234 |
| 5,092,378 | A * | 3/1992 | Dunham | B65B 67/02 141/236 |
| 6,158,484 | A | 12/2000 | Greenlee | |
| 8,474,493 | B2 | 7/2013 | Coker | |
| 9,162,864 | B1 * | 10/2015 | Wickramasinghe | A47G 33/002 |

* cited by examiner

*Primary Examiner* — Andrew D Stclair
(74) *Attorney, Agent, or Firm* — David I. Ellingson

(57) ABSTRACT

A communion cup filler apparatus that fills a full tray of serving cups simultaneously within several seconds. Each of a plurality of serving cups is positioned in an associated aperture in the tray. A distributor is attached above a base. The distributor includes a plurality of sloped polygon shapes, wherein each polygon shape includes an outlet hole; The tray is aligned between the base and distributor. A liquid is poured onto the distributor and is evenly divided among the serving cups.

15 Claims, 14 Drawing Sheets

Fig. 5
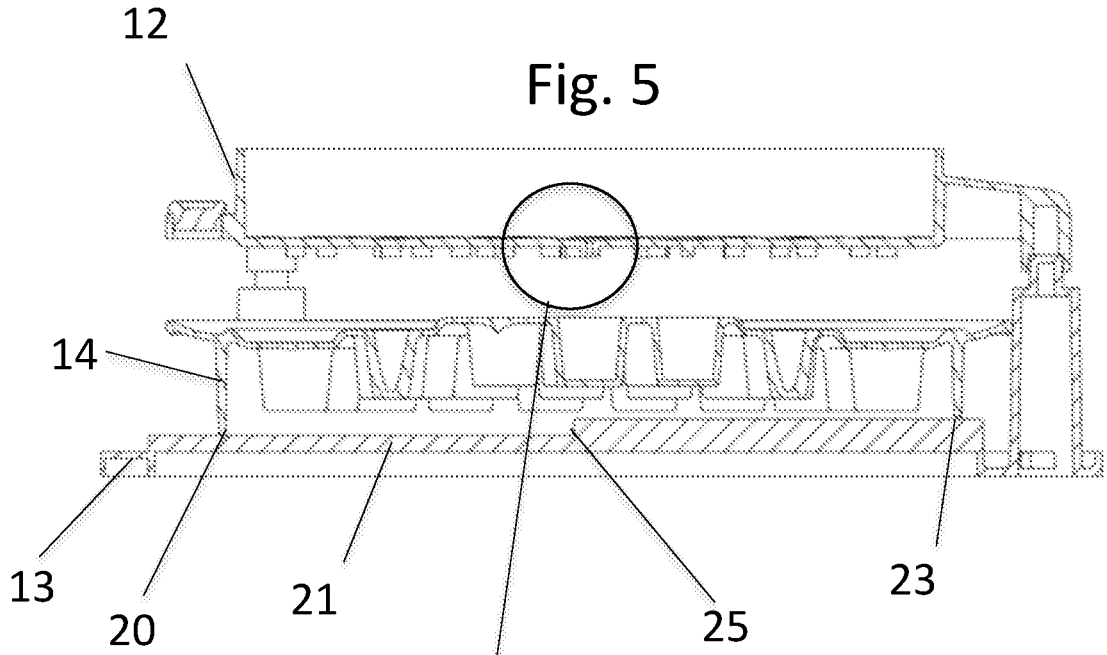
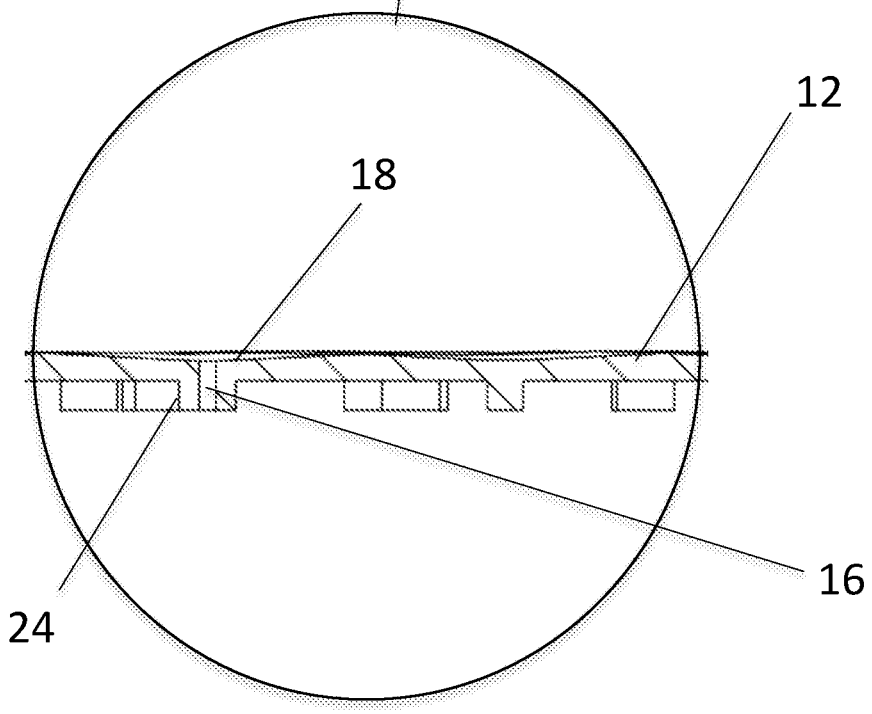
Fig. 6

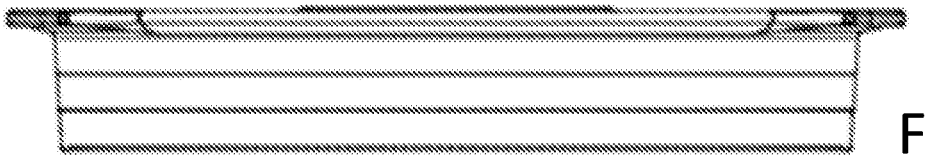
Fig. 10
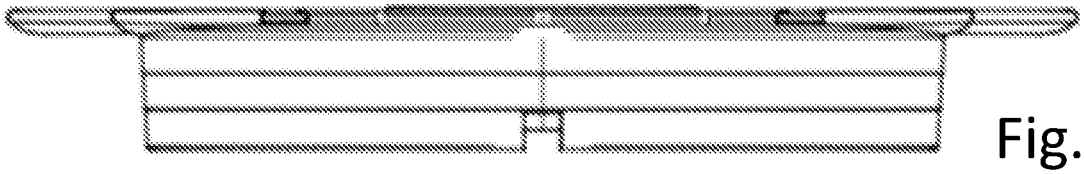
Fig. 11
Fig. 12
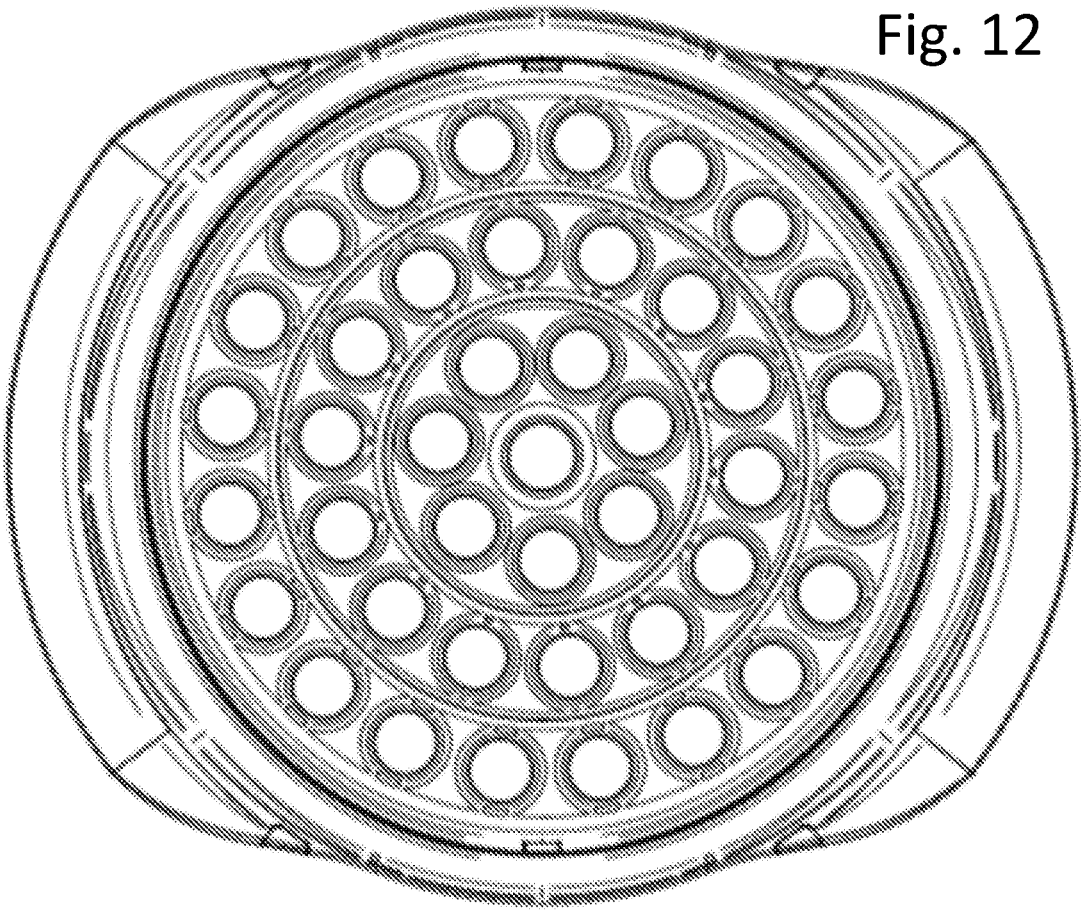

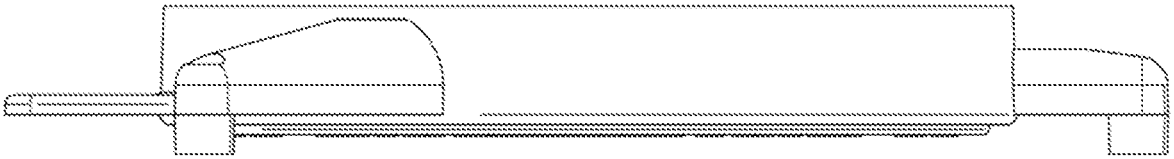
Fig. 16
Fig. 17
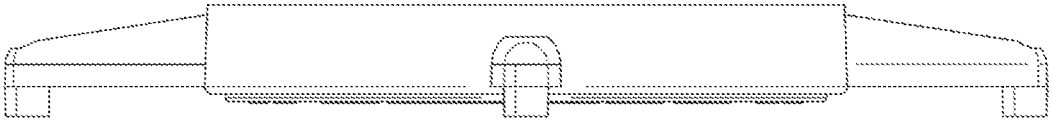
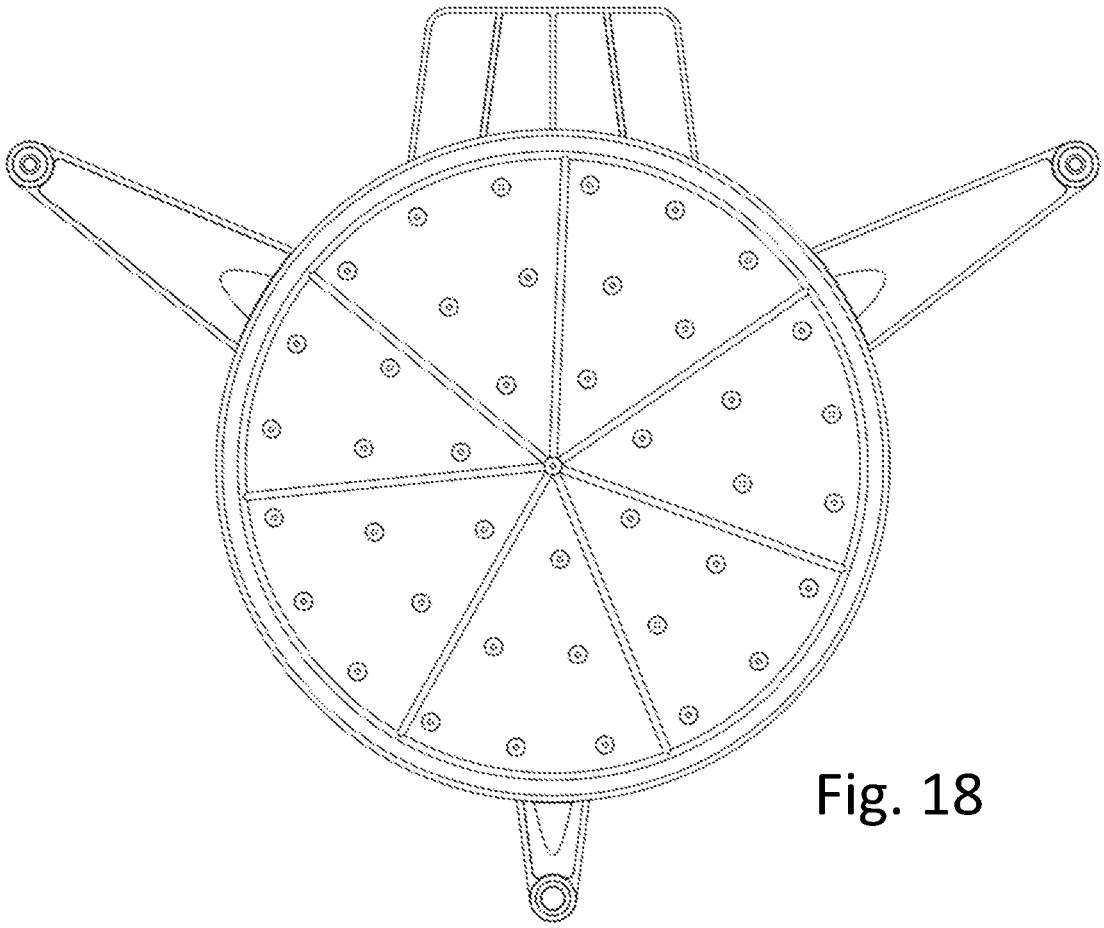
Fig. 18

Fig. 20
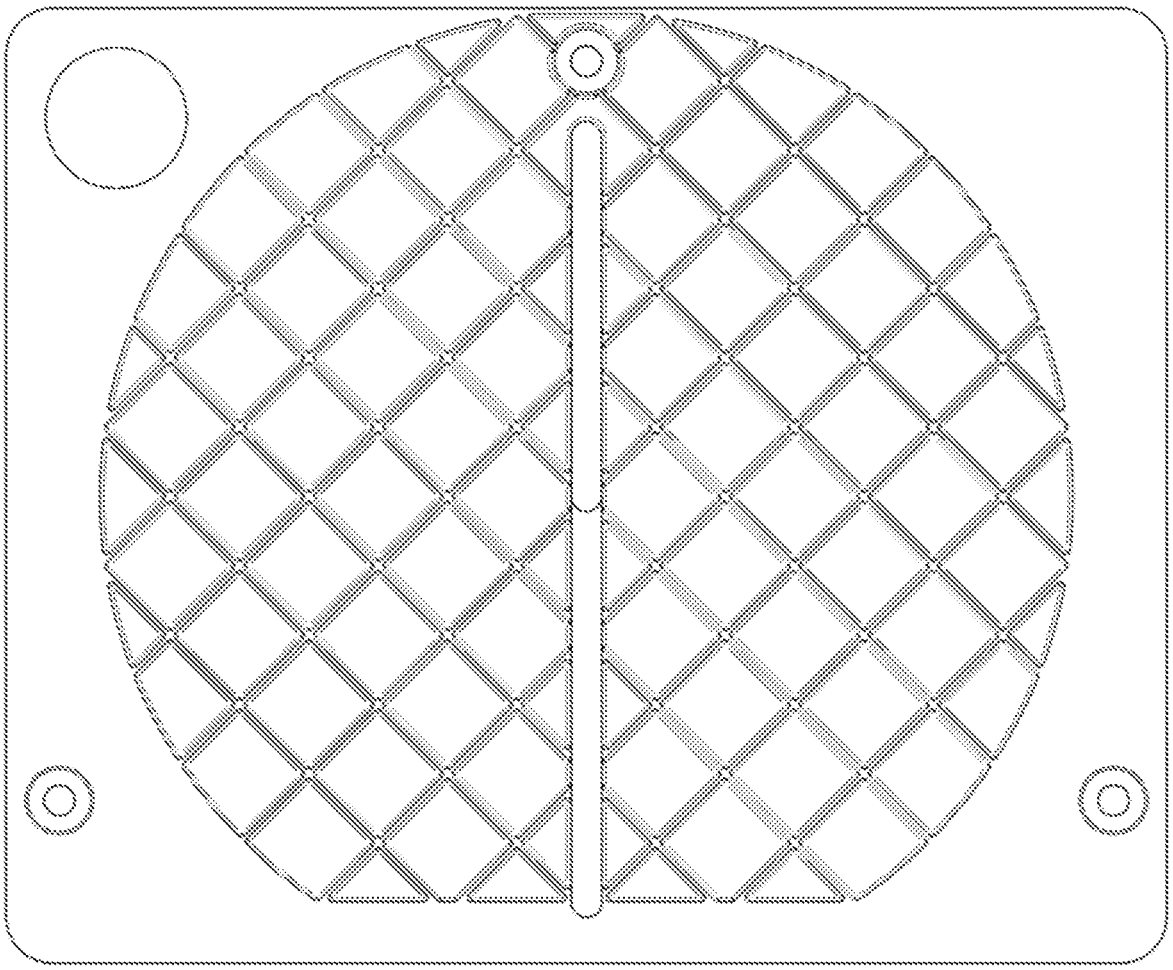
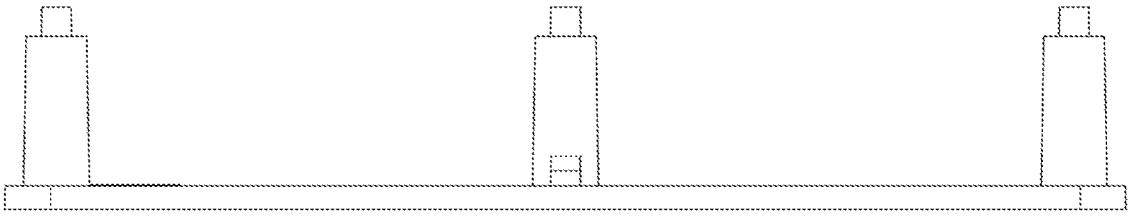
Fig. 21

Fig. 24
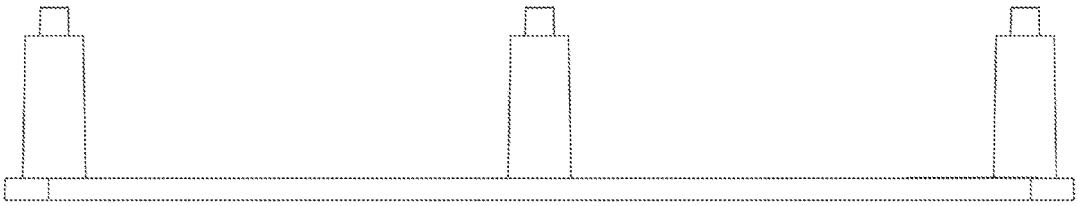
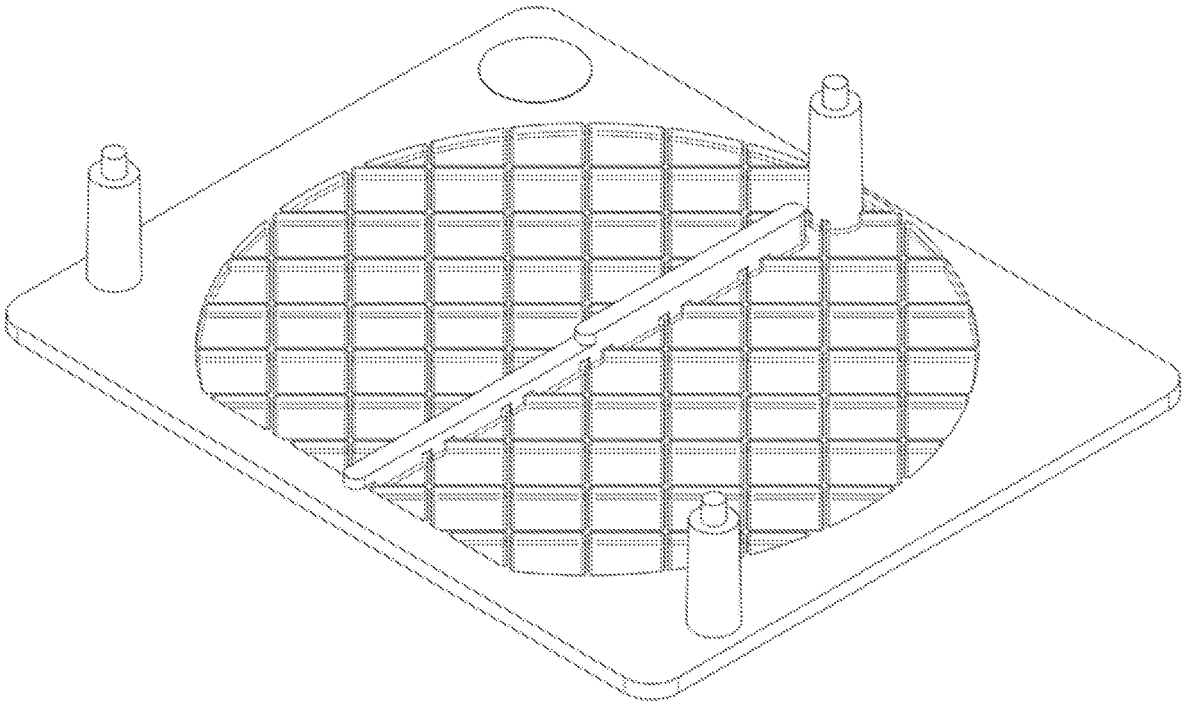
Fig. 25

COMMUNION CUP FILLER APPARATUS AND METHOD

CROSS-REFERENCE TO RELATED APPLICATIONS

This application claims priority to U.S. Provisional Patent Application Ser. No. 62/698,336 filed Jul. 16, 2018, titled "Communion Cup Filler Apparatus and Method", the entire contents of which is incorporated herein, both bodily and by reference.

FEDERALLY SPONSORED RESEARCH

Not Applicable

SEQUENCE LISTING OR PROGRAM

Not Applicable

FIELD OF THE INVENTION

The present invention relates to an apparatus for rapid filling of a tray of communion cups with liquid.

BACKGROUND OF THE INVENTION

Many churches serve communion on a weekly or monthly basis. Typically, these chuches utilize a communion tray that holds approximately forty individual communion cups. Each communion cup would hold approximately ⅓ fluid ounce of liquid. To manually fill each communion cup is a time consuming process.

An example device to fill an entire tray with one pour is disclosed in U.S. Pat. No. 3,196,909, entitled "Communion Glass Filler", issued Jul. 27, 1965. This device includes a substantially flat distributing pan with circular grooves that match the communion cup pattern. It also includes a plurality of radially extended grooves to interconnect the circular grooves. Formed in the trough of each of the concentric circular grooves are recesses which contain a hole to match the communion cup pattern.

Another example device to fill an entire tray with one pour is disclosed in U.S. Pat. No. 5,092,378, entitled "Communion Cup Filler", issued Mar. 3, 1992.

An example device to divide liquid equally among multiple containers is disclosed in U.S. Pat. No. 8,474,493, entitled "Liquid Apportionment Device", issue Jul. 2, 2013.

The disclosure of each of the above-cited U.S. patents is incorporated by reference herein.

SUMMARY OF THE INVENTION

The present invention is an improved filler apparatus. The improvements include ease of usage to align the tray with the distributor, ease of usage to fill the tray, less variation in amount of liquid per cup, and ease of cleaning of the apparatus after all the filling is completed.

The present invention includes a distributor with three support legs and a circular shape. The distributor includes holes matched to the communion cup tray pattern. Each distributor hole is centered within an inclined plane polygon.

The base includes a stepped rail to provide alignment for the tray. The tray includes a short notch in the front and a deep notch in the rear. The combination of these features properly aligns the tray with the distributor holes.

The distributor shape with inclined plane polygons eases cleaning. Hand or machine washing is effective due to the smooth surfaces and gentle angle transistions.

BRIEF DESCRIPTION OF THE DRAWINGS

FIG. 5 is a section view of the assembly taken along lines A-A of FIG. 3.
FIG. 6 is an enlargement of the hole taken from FIG. 5.
FIG. 10 is a right view of the tray.
FIG. 11 is a rear view of the tray.
FIG. 12 is a bottom view of the tray.
FIG. 16 is a right view of the distributor.
FIG. 17 is a rear view of the distributor.
FIG. 18 is a bottom view of the distributor.
FIG. 20 is a top view of the base.
FIG. 21 is a front view of the base.
FIG. 24 is a rear view of the base.
FIG. 25 is a an isometric top view of the base.

REFERENCE NUMERALS

10 Assembly
11 Thumb screw
12 Distributor
13 Base
14 Tray
15 Insert
16 Hole
17 Wall
18 Slope
19 Bubble level
20 Short notch
21 Rail
22 Grid
23 Tall notch
24 Protrusion
25 Step

DETAILED DESCRIPTION OF THE DRAWINGS

Figure 1:
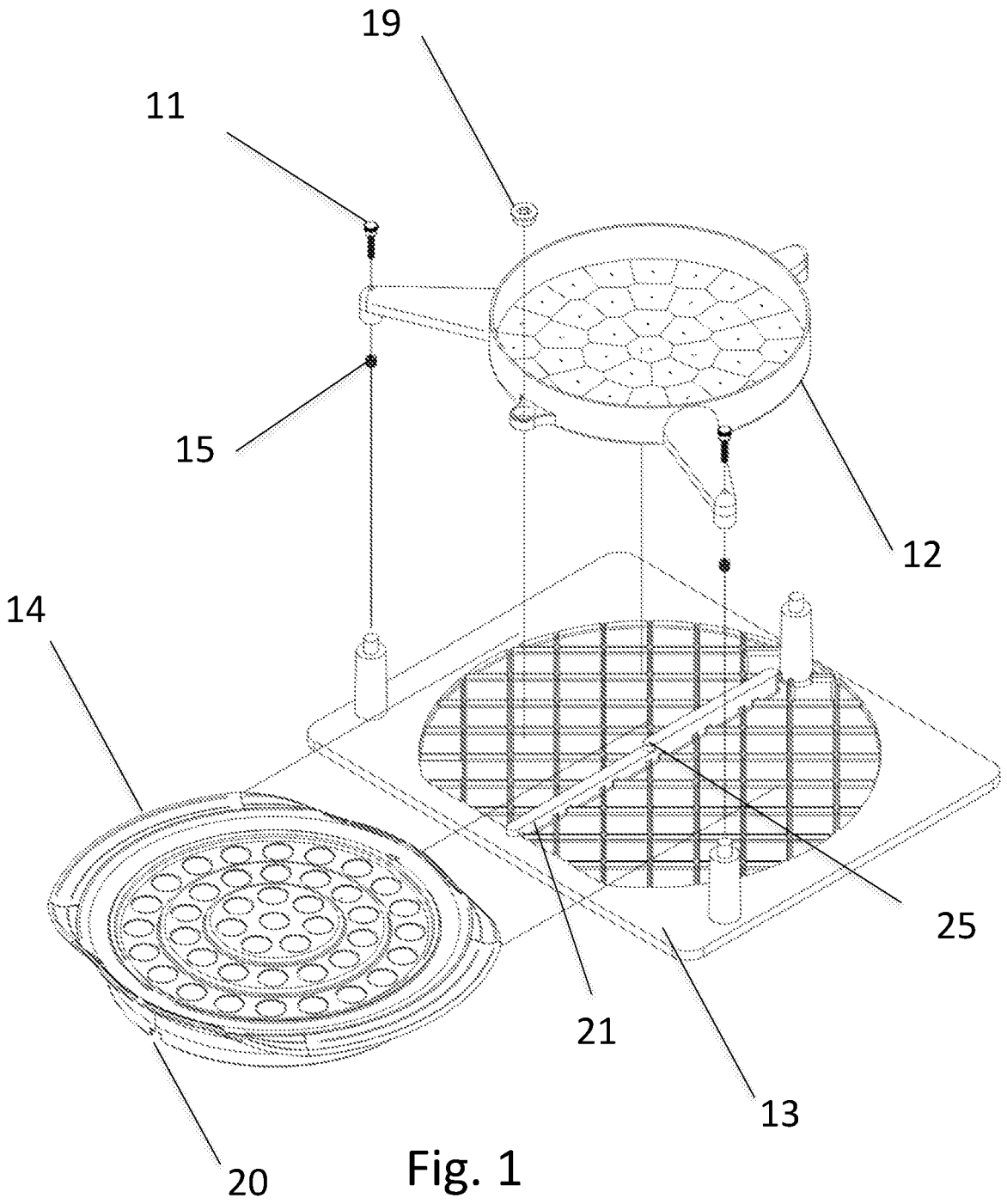
FIG. 1 is a top isometric exploded view of the assembly.

FIG. 1 is a top isometric exploded view of the assembly (10). The two inserts (15) have an internal thread. They are press fit into openings on the bottom of two legs on the distributor (12). The thumb screws (11) are threaded into the inserts (15). The bubble level (19) has a press or adhesive fit to the distributor (12).

The base (13) includes a stepped rail (21) to provide alignment for the tray (14). The rail (21) increases in height midway to the rear of the base (13). The tray (14) includes a short notch (20) in the front and a tall notch (23) in the rear. The rail (21) interaction with the short notch (20) and tall notch (23) provides angular alignment of the tray (14) to the base (13). The rail (21) includes a step (25) to prevent the tray (14) being inserted in a reveresed front to rear manner. The tray (14) is inserted to the base (13) until the tray (14) contacts the rear post. This assures that the tray (14) is fully inserted.

The grid (22) pattern on the base (13) provides an area to collect fluid drips, keep them off the tray (14) and keep them off the counter or table.

Figure 2:
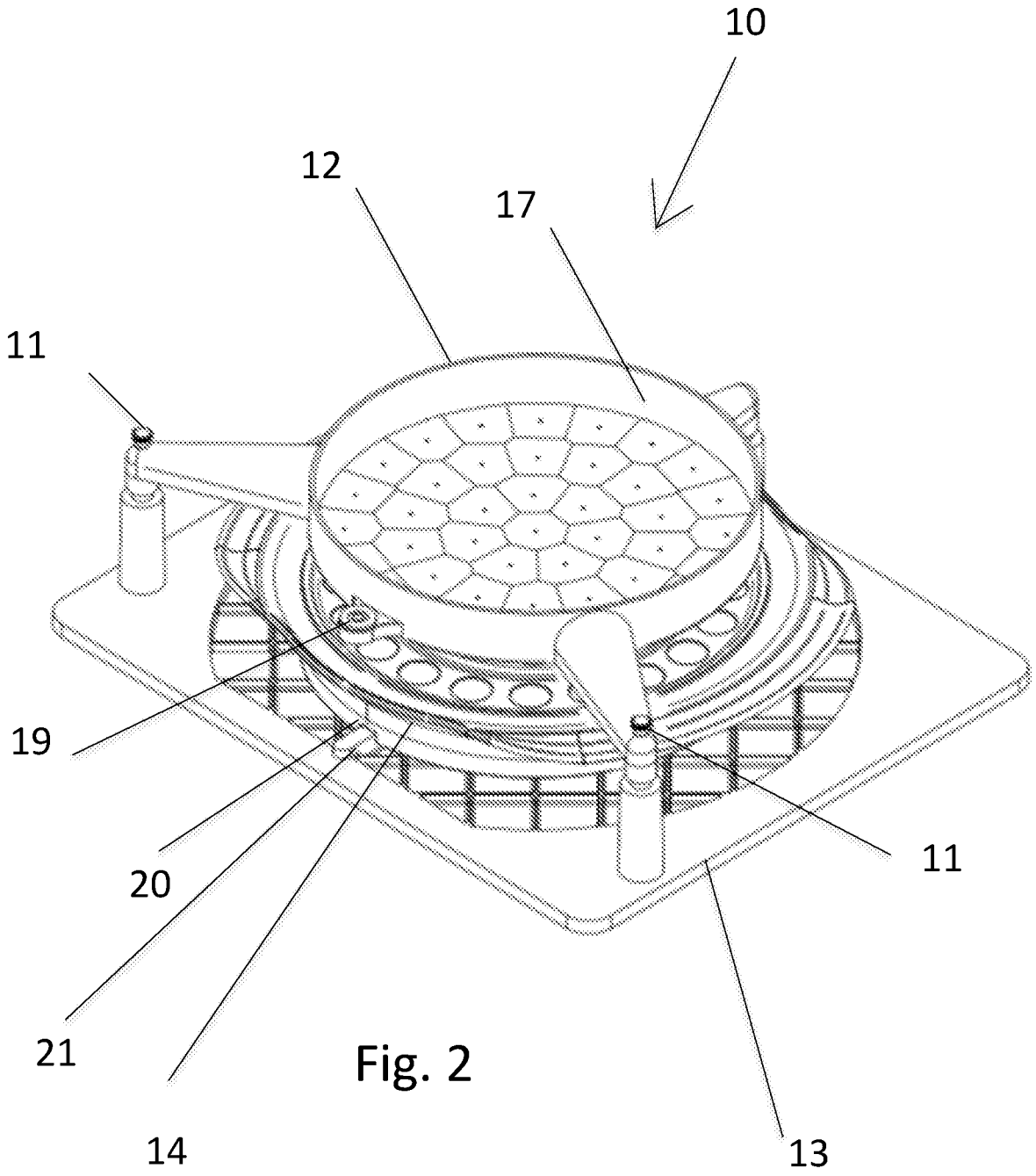
FIG. 2 is a top isometric view of the assembly.

FIG. 2 is a top isometric view of the assembly (10). The tray (14) has been properly inserted into the base (13). Note the short notch (20) fit over the rail (21).

It is important for proper filling that the distributor (12) is reasonably level. Due to counter or table variation, the base (13) may be somewhat off level when placed on the counter or table. An off level of over 1 degree would cause excessive cup to cup liquid variation. To compensate, the user would adjust the thumbscrews (11) as needed until the bubble level (19) is visually centered. With the bubble level (19) visually centered, the distributor (12) off level would be less than 1 degree.

The user is instructed to pour the liquid into the distributor (12) in a moderately quick manner. This causes the liquid to quickly spread over the distributor (12) and cover all the holes (16) in a short period of time. Having all the holes (16) covered simultaneously is an important parameter toward equal liquid being dispensed into all the cups.

When the liquid is poured into the distributor (12) in this moderately quick manner, some wave action or slight splashing is normal. The wall (17) contains the liquid during this wave action or slight splashing.

Figure 3:
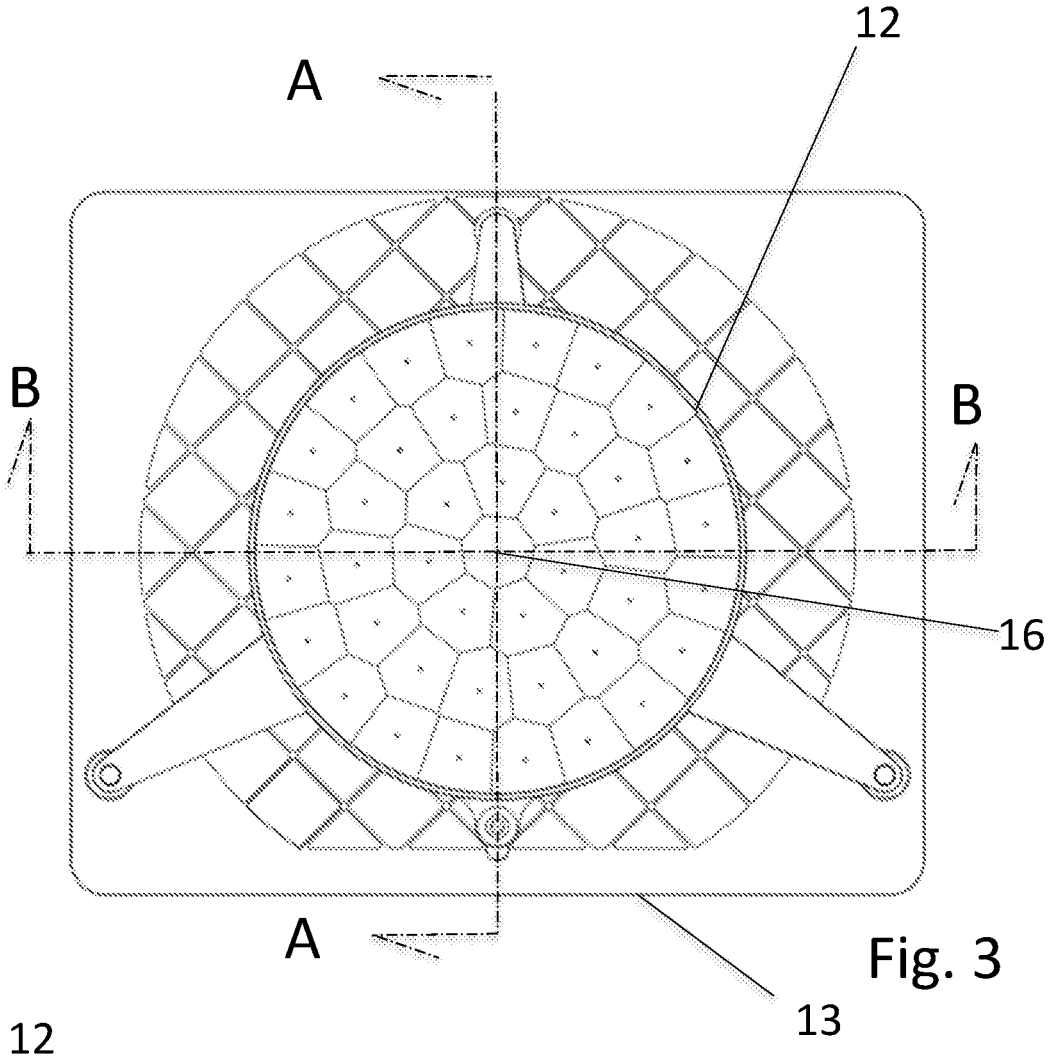
FIG. 3 is a top view of the assembly.
Figure 7:
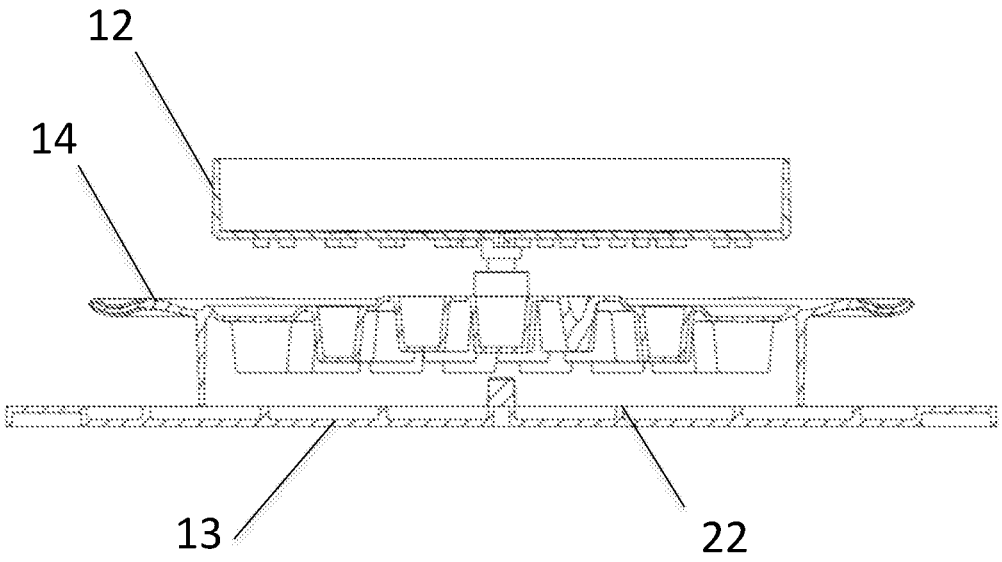
FIG. 7 is a section view of the assembly taken along lines B-B of FIG. 3.
Figure 8:
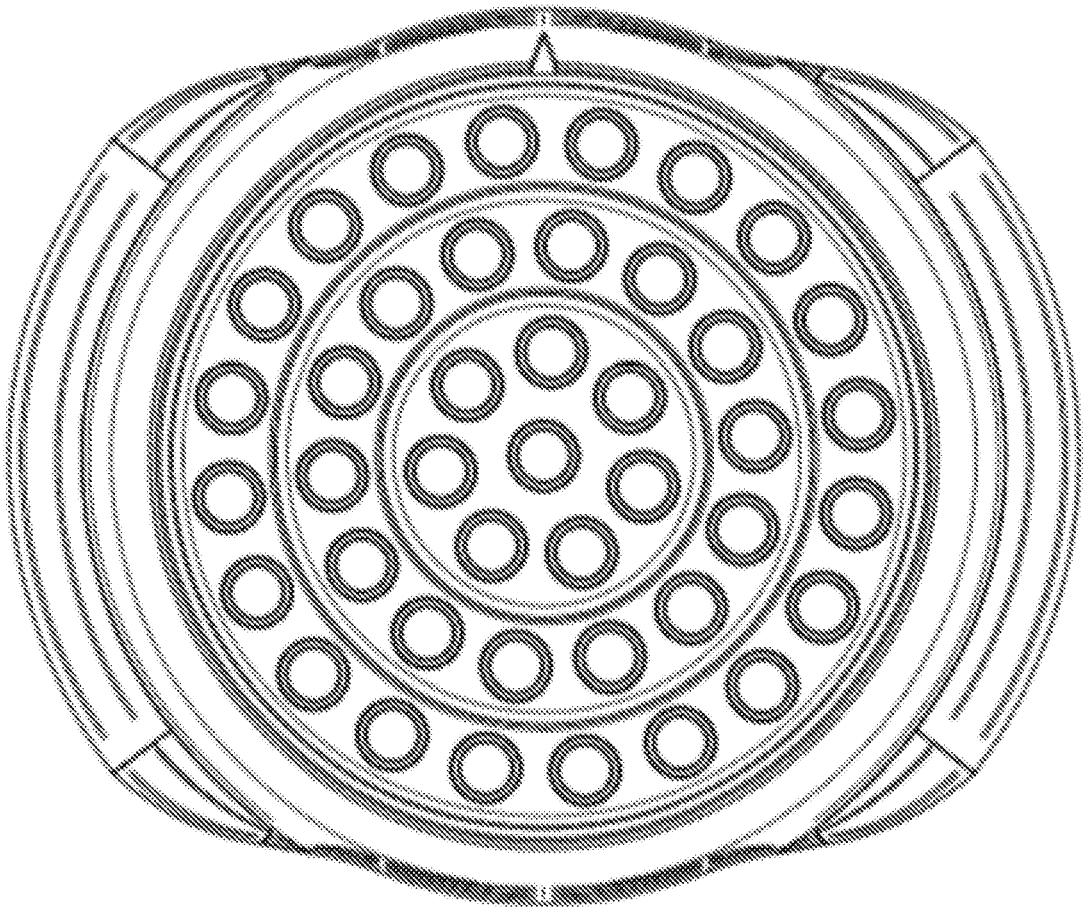
FIG. 8 is a top view of the tray.
Figure 9:
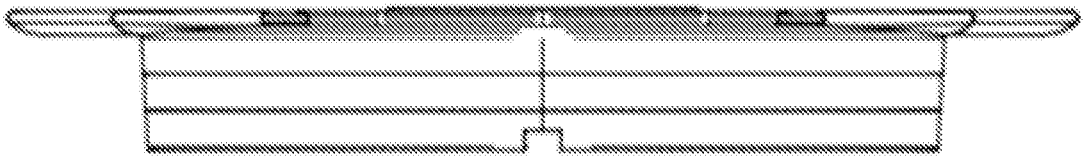
FIG. 9 is a front view of the tray.
Figure 13:
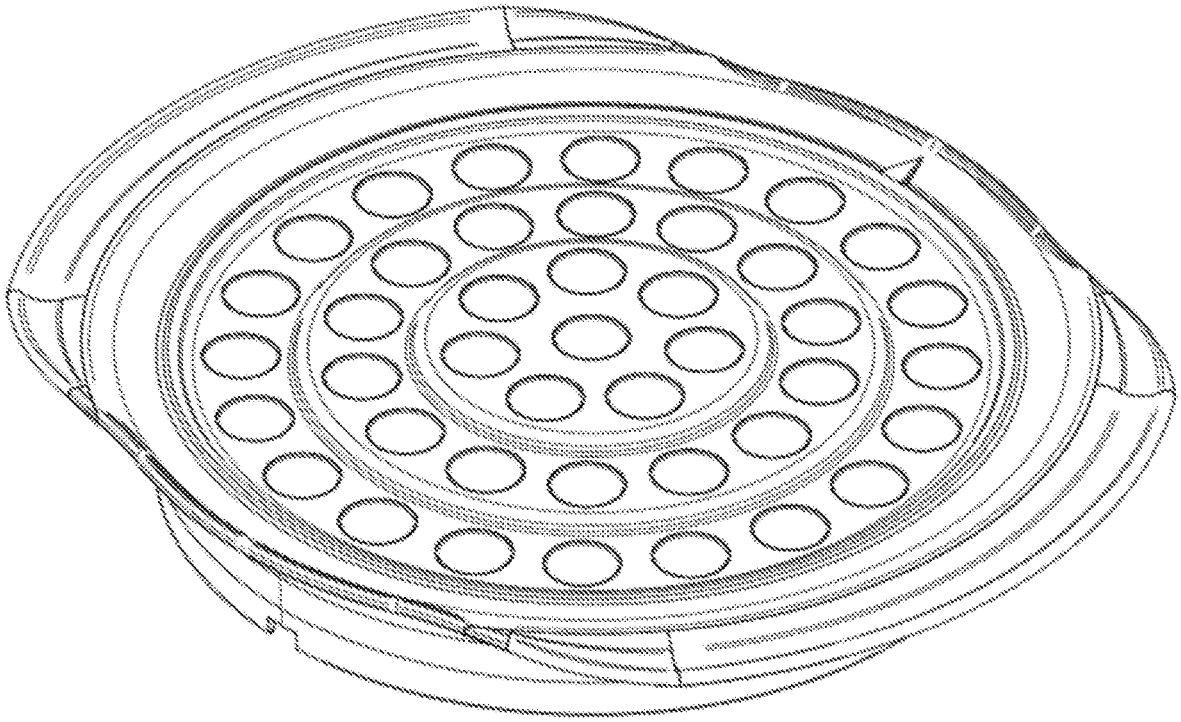
FIG. 13 is a an isometric top view of the tray.
Figure 14:
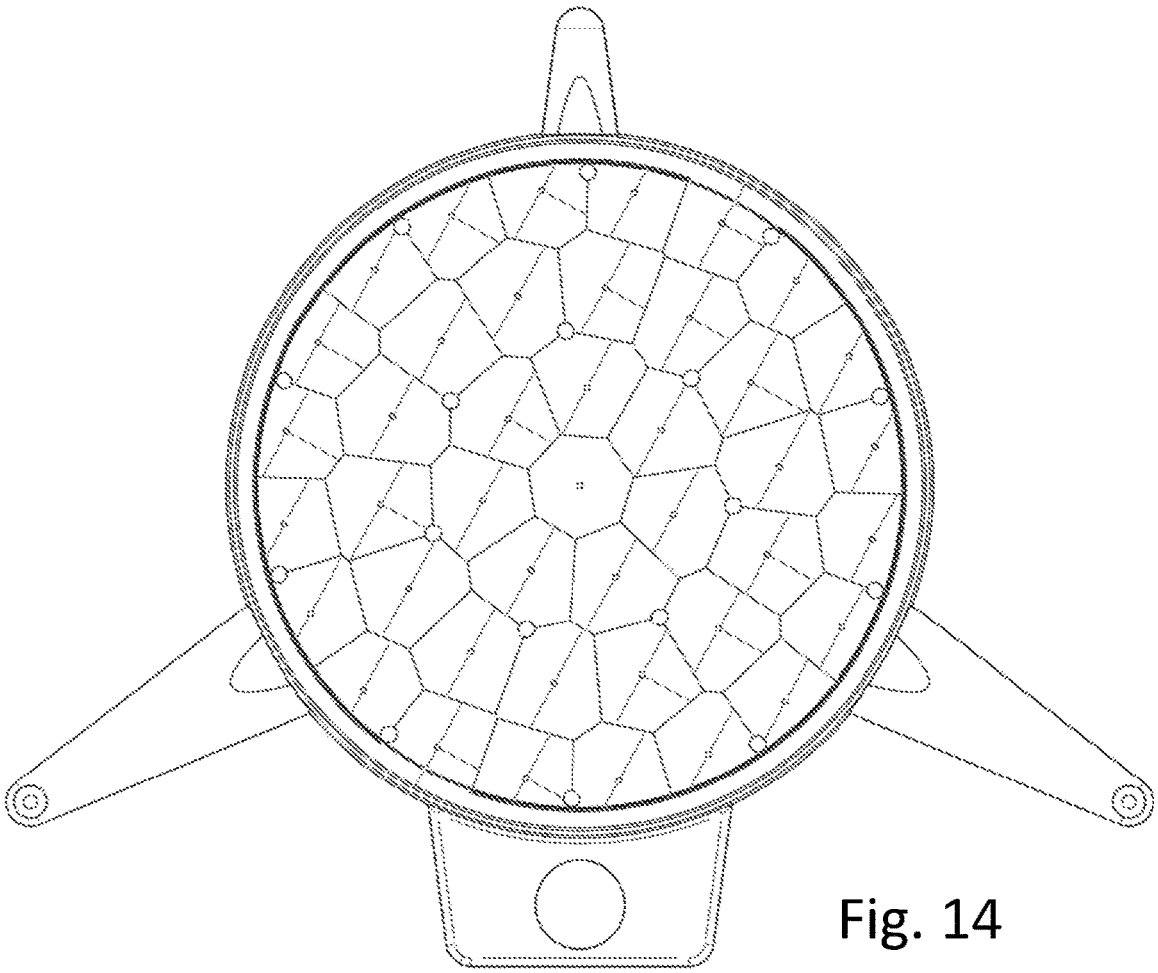
FIG. 14 is a top view of the distributor.
Figure 15:
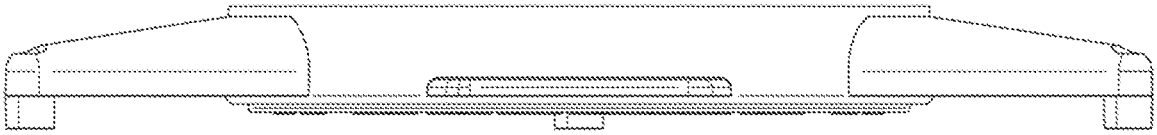
FIG. 15 is a front view of the distributor.
Figure 19:
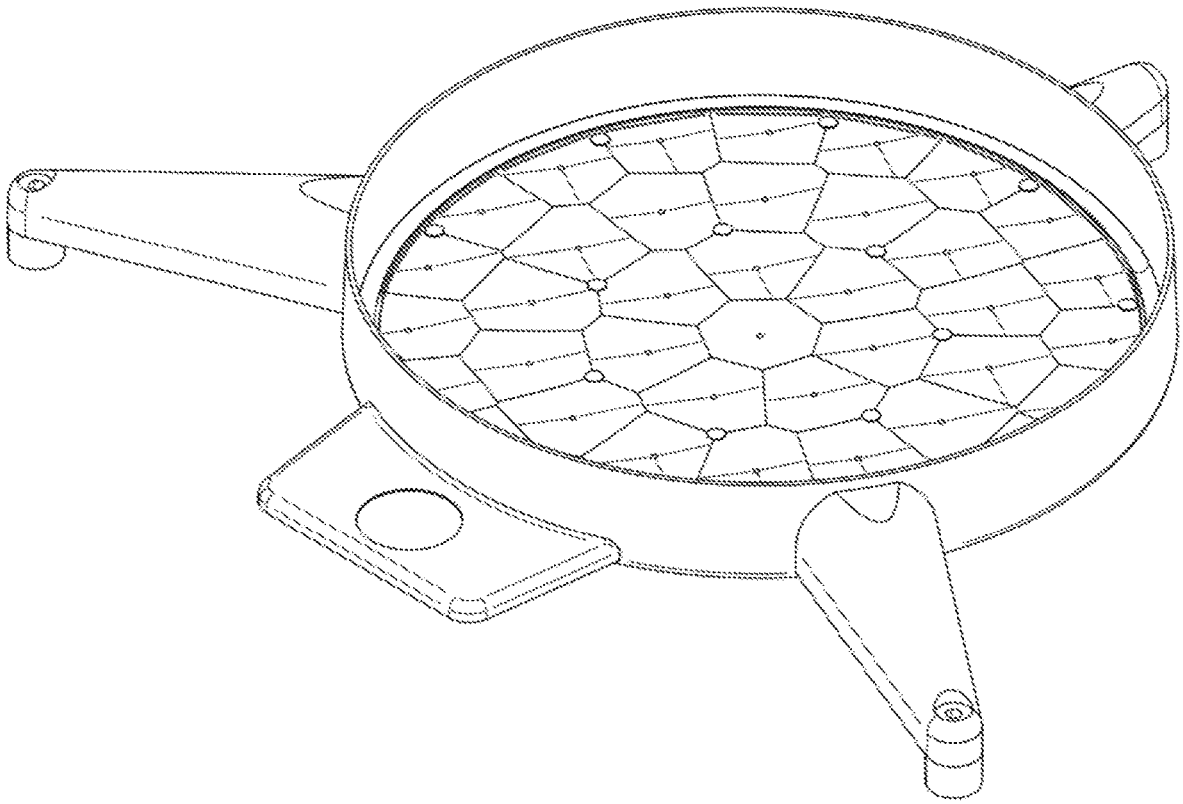
FIG. 19 is a an isometric top view of the distributor.
Figure 22:
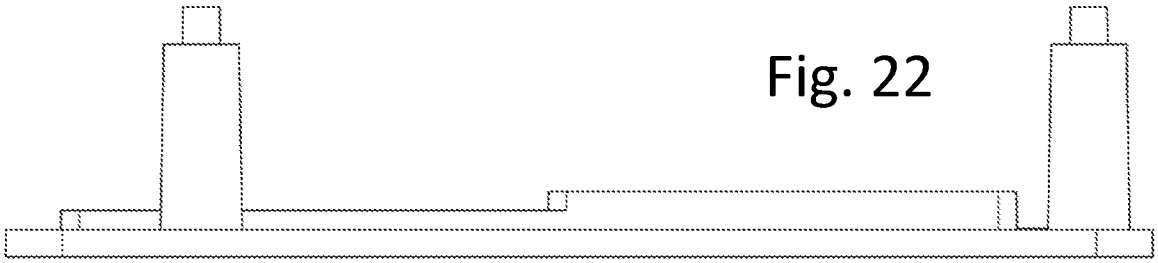
FIG. 22 is a right view of the base.
Figure 23:
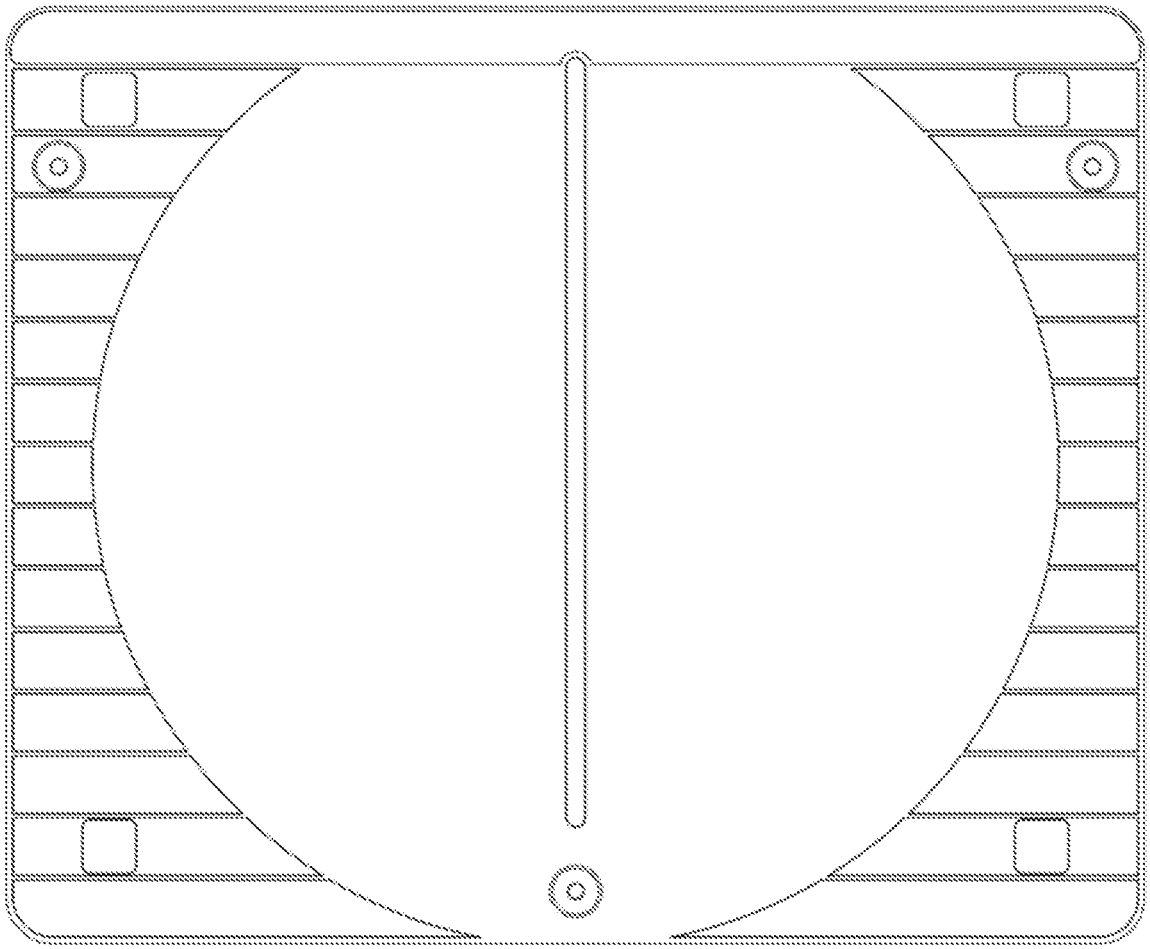
FIG. 23 is a bottom view of the base.

FIG. 3 is a top view of the assembly (10). The tray (14) is not included in this view. The tray (14) is included in the two cross section views (FIGS. 5 and 7).

The holes (16) in the distributor (12) match the pattern of cup receptacles on the tray (14). The pattern of polygon shapes arranged around the holes (16) causes an equal amount of fluid to flow into each cup and assures that all the fluid exits the distributor (12). This equal flow is caused by each polygon shape having the same area and all of the holes (16) having the same diameter. In the example distributor (12) shown, the wall (17) has a diameter of approximately 10.5 inches and the holes (16) have a diameter of approximately 0.086 inches.

Figure 4:
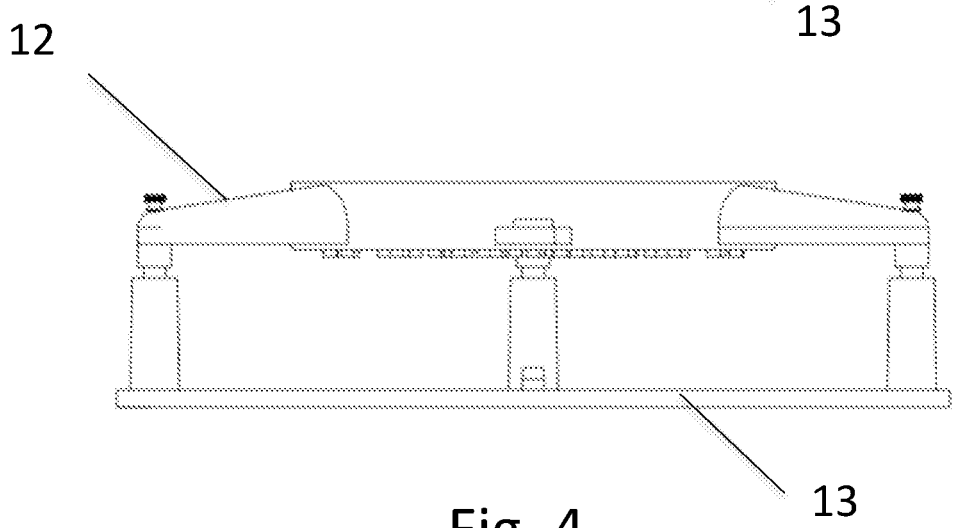
FIG. 4 is a front view of the assembly.

FIG. 4 is a front view of the assembly (10). The tray (14) is not included in this view.

FIG. 5 is a section view of the assembly (10) taken along lines A-A of FIG. 3. For clarity, the view has been rotated clockwise 90 degrees. The step (25) in the rail (21) is shown. Note the short notch (20) at the front of the tray (14) and the tall notch (23) at the rear of the tray. To provide correct tray (14) alignment, only the tall notch (23) will clear the step (25).

FIG. 6 is an enlargement of the hole taken from FIG. 5. The slope (18) is an angled plane surface that starts at each edge of the polygon and terminates at the hole (16). The slope (18) has an angle from horizontal of approximately 3 degrees.

At the bottom of the distributor (12), each hole (16) is surrounded with a protrusion (24). This feature reduces dripping and causes the exiting fluid to take a more vertical laminer flow path toward the cup.

FIG. 7 is a section view of the assembly taken along lines B-B of FIG. 3. The base (13) has a solid bottom and includes the grid (22) details that protrude up.

The apparatus would be operated as follows:

a. The user would place the assembly (10) on a counter top or table. The tray (14) would not be inserted into the assembly (10) at this time.

b. The user would observe the indication of the level (19).

d. The user would rotate the thumb screws (11), (CW or CCW) as needed, to center the indication of the bubble level (19).

e. The user would fill all the openings in the tray (14) with individual serving cups.

f. Orienting the tray (14) so that the tray (14) will install completely along the step (25) of the alignment rail (21), the user would fully insert the tray (14) into the base (13).

g. The user would fill a graduated container with fluid (typically 14 ounces of fluid for a tray with 40 openings.)

h. The user would pour the fluid into the distributor (12) in a moderately quick manner.

i. The user would wait for the fluid to exit the distributor (12) via the holes (16) and fill the cups.

j. The user would slide the tray (14) out from the base (13).

k. The user would repeat steps (e) thru (j) with as many trays (14) as needed.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawings and description in this disclosure are provided to help the reader understand the invention, and do not limit the scope of the claims.

The invention claimed is:

1. An apparatus for simultaneously distributing a substantially equal volume of a liquid to a plurality of liquid receptacles positioned on a tray comprising:

the tray;

a base positioned under the tray;

a distributor supported on the base and positioned over the tray;

the distributor includes a plurality of polygon shapes, wherein each polygon shape includes an outlet hole;

a perimeter of each polygon shape includes a vertical wall of 0.050 inch or more in height, all of the polygon surface inside the perimeter slopes toward the outlet hole, wherein the polygon shapes mesh utilizing the vertical walls as common edges;

the outlet holes are positioned to be vertically disposed over the liquid receptacles; and the liquid is poured on the distributor, flows over the polygon shapes, through the outlet holes, and into the liquid receptacles.

2. The apparatus of claim 1 wherein, the base includes a stepped rail and the tray includes a notch, such that the notch to the stepped rail interaction causes alignment of the tray relative to the base.

3. The apparatus of claim 2 wherein, the distributor includes a vertical cylindrical wall, and the polygon surfaces are positioned inside the vertical cylindrical wall.

4. The apparatus of claim 3 wherein, the distributor includes means to indicate a level of the distributor and the base includes means for adjustment of the level.

5. An apparatus for distributing a liquid comprising:

a plurality of liquid receptacles positioned on a tray;

a base positioned under the tray;

a distributor supported on the base and positioned over the tray;

the distributor includes a plurality of polygon shapes, wherein each polygon shape includes an outlet hole;

the outlet holes are positioned to be vertically disposed over the liquid receptacles;

the distributor includes means to indicate a level of the distributor and the base includes means for adjustment of the level;

whereby the liquid poured on the distributor is evenly dispersed through the outlet holes and into the liquid receptacles.

6. The apparatus of claim 5 wherein, the distributor includes a vertical cylindrical wall, and the polygon surfaces are positioned inside the vertical cylindrical wall.

7. The appartus of claim 6 wherein, a perimeter of each polygon shape includes a vertical wall of 0.050 inch or more in height.

8. The apparatus of claim 7 wherein, the polygon shapes mesh utilizing the vertical walls as common edges.

9. The apparatus of claim 7 wherein, all of the polygon surface inside the perimeter slopes toward the outlet hole.

10. The apparatus of claim 8 wherein, the outlet holes are surrounded with a protrusion of 0.050 inch or more in height on the bottom of the distributor.

11. The apparatus of claim 10 wherein, the base includes a stepped rail and the tray includes a notch, such that the notch to the stepped rail interaction causes alignment of the tray relative to the base.

12. A method of distributing a liquid to a plurality of liquid receptacles, the method comprising:

providing a distributor supported on a base;

placing a plurality of liquid receptacles into openings on a tray;

positioning the tray under the distributor; and pouring a liquid on the distributor, wherein the distributor includes polygon shapes with outlet holes which cause the liquid to equally divide into the liquid receptacles;

wherein a perimeter of each polygon shape includes a vertical wall of 0.050 inch or more in height, all of the polygon surface inside the perimeter slopes toward the outlet hole, the outlet holes are positioned to be vertically disposed over the liquid receptacles, and the polygon shapes mesh utilizing the vertical walls as common edges.

13. The method of claim 12, wherein the base includes a stepped rail and the tray includes a notch, such that the notch to the stepped rail interaction causes alignment of the tray relative to the base.

14. The method of claim 13, wherein, the distributor includes a vertical cylindrical wall, and the polygon surfaces are positioned inside the vertical cylindrical wall.

15. The method of claim 12 wherein, the distributor includes means to indicate a level of the distributor and the base includes means for adjustment of the level.

* * * * *